US006877326B2

(12) United States Patent
Kim

(10) Patent No.: US 6,877,326 B2
(45) Date of Patent: Apr. 12, 2005

(54) OPERATION CONTROL APPARATUS AND METHOD OF LINEAR COMPRESSOR

(75) Inventor: Jae-Ho Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/390,609

(22) Filed: Mar. 19, 2003

(65) Prior Publication Data

US 2003/0177773 A1 Sep. 25, 2003

(30) Foreign Application Priority Data

Mar. 20, 2002 (KR) ..... 10-2002-0015101
Mar. 20, 2002 (KR) ..... 10-2002-0015102
Mar. 20, 2002 (KR) ..... 10-2002-0015104
Mar. 20, 2002 (KR) ..... 10-2002-0015100

(51) Int. Cl.[7] ..... F25B 9/00
(52) U.S. Cl. ..... 62/6; 62/230
(58) Field of Search ..... 62/6, 156, 215, 62/230

(56) References Cited

U.S. PATENT DOCUMENTS 4,902,952 A * 2/1990 Lavery ..... 318/645
5,809,792 A * 9/1998 Song ..... 62/6 X

* cited by examiner

*Primary Examiner*—Harry B. Tanner
(74) *Attorney, Agent, or Firm*—Fleshner & Kim, LLP

(57) ABSTRACT

An operation control apparatus and method of a linear compressor are disclosed. The operation control apparatus includes: an ambient temperature sensor unit for sensing a temperature around a refrigerator; a second microcomputer for outputting a control signal according to a temperature statue of a temperatures sensing unit for sensing an inner temperature of the refrigerator; a load driving unit for receiving an ON/OFF control signal for driving a linear compressor from the second microcomputer and outputting a drive signal to the linear compressor; a relay switched by the driving signal and supplying an AC power to a motor of the linear compressor; and a power supply unit for converting the AC power into a DC power and supplying power to each unit inside the linear compressor.

21 Claims, 6 Drawing Sheets

OPERATION CONTROL APPARATUS AND METHOD OF LINEAR COMPRESSOR

BACKGROUND OF THE INVENTION

1. Field of the Invention

The present invention relates to an operation control apparatus, and method of a linear compressor, and more particularly, to an operation control apparatus and method of a linear compressor that are capable of controlling a motor by turning on/off power of a controller of a linear compressor through a main controller of a refrigerator, capable of restraining an abnormal operation and improving a performance of a motor by compensating an error of a stroke voltage, and capable of removing a noise signal generated at an instantaneous power failure of a switching control signal generated from a microcomputer controlling the linear compressor.

2. Description of the Background Art

In general, a linear compressor generates a rotational torque by ON/OFF controlling power supplied to a coil wound on a multi-phase stator by using a switching device. Accordingly, by sequentially varying an excitation state between a rotor and the stator of a motor, a forward rotational torque ⇑ be generated according to a magnetic suction force.

If a specific excitation state of the motor is not varied, the rotor may be stopped at a certain position, and various driving control can be possibly made to generate a reverse rotatory force by controlling a phase of an input pulse signal applied to the switching device by taking a maximum inductance as an origin. As such, the motor is adopted for use in electronic products which need a direction control. Especially, a linear compressor used for a refrigerator or an air-conditioner, a compression ratio can be varied by a voltage applied to the motor, and thus, its cooling force can be variably controlled according to an intention of a user.

The operation control apparatus of a linear compressor in accordance with a conventional art will now be described.

FIG. 1 is a circuit diagram showing the construction of an operation control apparatus of a linear compressor in accordance with a conventional art.

As shown, the conventional operation control apparatus of a linear compressor includes: a linear compressing unit (L.COMP) for controlling a cooling force by vertically moving a piston and varying a stroke by an AC power voltage applied to an internal motor (M); a current detecting unit 20 for detecting a current applied to the linear compressing unit (L.COMP) as the stroke increases by the applied voltage; a voltage detecting unit 30 for detecting a voltage generated at the linear compressor (L.COMP) as the stroke increases by the applied voltage; a microcomputer 40 for calculating a stroke of a certain time point with the current and the voltage respectively detected by the current detecting unit 20 and the voltage detecting unit 30, comparing the stroke at the certain time point and a reference stroke command value, and outputting a switching control signal according to the comparison value; and an electric circuit unit 10 for applying a voltage to the linear compressing unit (L.COMP) by ON/OFF controlling an input AC power voltage through a triac (Tr1) according to the switching control signal of the microcomputer 40.

The operation of the conventional operation control apparatus of a linear compressor constructed as described will now be explained.

To begin with, in the linear compressor (L.COMP), the piston is vertically moved by the applied voltage according to a stroke command value set by a user, according to which the stroke is varied to control a cooling force.

In the electric circuit unit 10, as the turn-on period of the triac (Tr1) is lengthened by the switching control signal of the microcomputer, a stroke increase, and at this time, the current and the voltage applied to the motor (M) of the linear compressing unit (L.COMP) are respectively detected by the current detecting unit 20 and the voltage detecting unit 30 and inputted to the microcomputer 40.

The microcomputer 40 calculates a stroke at a certain time point by using the applied current and the applied voltage detected by the current detecting unit 20 and the voltage detecting unit 30, compares the stroke with a reference stroke command value, and outputs a switching control signal according to the comparison value. If the stroke at the certain time point is smaller than the reference stroke command value, the microcomputer 40 outputs a switching control signal for lengthening the ON period of the triac (Tr1) to increase the voltage applied to the linear compressing unit (L.COMP).

If, however, the stroke at the certain time point is greater than the reference stroke command value, the microcomputer 50 outputs a switching control signal for shortening the ON period of the triac (Tr1) to reduce the voltage applied to the linear compressing unit (L.COMP), thereby driving the motor (M) of the linear compressing unit (L.COMP).

FIG. 2 is a waveform of the current applied to the linear compressing unit of FIG. 1.

As the triac (Tr1) of the electric circuit unit 10 is turned on by the microcomputer 40, the current applied to the linear compressing unit (L.COMP) has a certain waveform. The motor (M) of the linear compressing unit (L.COMP) performs a compressing stroke at the positive (+) current and an expanding stroke at the negative stroke.

In case that a refrigerator operates, when portion of moisture contained in a food item is circulated along with a cooking air inside the refrigerator, it is frozen at an evaporator, forming frost. The frost is sensed by a defrosting sensor (not shown) mounted at the evaporator and removed as a defrosting heater is heated according to a defrosting operation. At this time, the defrosting operation is performed with a stroke distance reduced.

FIG. 3 is an exemplary view showing a compressing unit of a general linear compressor.

As shown, the compressing unit of the conventional linear compressor includes: a cylinder 10 hollowed with a certain inner diameter; a piston 20 inserted into the cylinder and reciprocally and linearly moved upon receiving a driving force of the motor; a discharge cover 30 coupled at one side of the cylinder 10 to cover the section of the piston 20 inserted in the cylinder 10 and a compression space (P) formed in the cylinder 10; a discharge valve 40 inserted in the discharge cover 30 and opening and closing the compression space (P) of the cylinder 10; and a valve spring 50 for elastically supporting the interior of the discharge cover 30 and the discharge valve 40.

However, during the defrosting operation of the refrigerator, the refrigerator is overloaded therein, and according to a temperature change inside the refrigerator, the piston 20 is escaped from the cylinder 10 after passing an upper dead center and gets into the discharge cover 30, to collide with and damage the discharge valve 40.

In addition, an error occurs inevitably during a calculation of the stroke voltage with the output voltage and the output current applied to the microcomputer 40. Therefore, it is not possible to precisely control the motor (MO of the linear compressing unit (L.COMP), and the motor is abnormally operated and its performance is degraded.

Moreover, when the compressor is instantly turned on/off (power failure), a gate signal is generated to turn on the triac (Tr1) regardless of a triac (Tr1) operation signal in the microcomputer 40, resulting in a malfunction of the linear compressor.

SUMMARY OF THE INVENTION

Therefore, an object of the present invention is to provide an operation control method of a linear compressor in which when an initial power input is sensed by sensing an inner temperature of a refrigerator, a stroke voltage of a linear compressor is controlled to be lower than a general operation control state, whereas if a temperature sensed by a defrosting sensor is below a pre-set temperature, the linear compressor is operated with a normal stroke voltage, thereby suitably controlling the inner temperature of the refrigerator and obtaining a reliability in case of an overload by preventing collision between a piston and a discharge valve.

Another object of the present invention is to provide an operation control method of a linear compressor in which a current and a voltage applied to a motor of a linear compressing unit are detected, based on which a stroke voltage at a certain time point is calculated, the calculated stroke voltage and a reference stroke command value are compared, an error compensation signal according to the comparison value is applied to a first microcomputer, and the first microcomputer controls the motor of the linear compressing unit with a switching control signal according to the error compensation signal, thereby solving an abnormal operation of the motor of the linear compressing unit and improving a performance of the motor.

Still another object of the present invention is to provide an operation control apparatus of a linear compressor in which in order to prevent an instantaneous output of a gate signal of a triac regardless of an operation signal of a motor, a Zener diode is connected in a reverse direction of a direction that the gate signal is supplied to the triac in order to cut off a switching control signal the microcomputer supplies to the triac due to an instantaneous power failure by using such characteristics of the Zener diode that it disregards a reverse current until it reaches a breakdown voltage, thereby preventing a malfunction of the linear compressor.

To achieve these and other advantages and in accordance with the purpose of the present invention, as embodied and broadly described herein, there is provided a main controller of a refrigerator including: an ambient temperature sensor unit for sensing a temperature around a refrigerator; a second microcomputer for outputting a control signal according to a temperature statue of a temperatures sensing unit for sensing an inner temperature of the refrigerator; a load driving unit for receiving an ON/OFF control signal for driving a linear compressor from the second microcomputer and outputting a drive signal to the linear compressor; a relay switched by the driving signal and supplying an AC power to a motor of the linear compressor; and a power supply unit for converting the AC power into a DC power and supplying power to each unit inside the linear compressor.

To achieve the above objects, there is also provided a controller of a linear compressor including: a current detecting unit for detecting a current applied to the linear compressor by increasing a stroke by a voltage applied to a motor; a voltage detecting unit for detecting a voltage generated at the linear compressing unit; a stroke calculating unit for detecting a stroke at a certain time point according to the current and the voltage respectively detected by the current detecting unit and the voltage detecting unit; a stroke voltage compensating unit for comparing the detected stroke at the certain time point and a reference stroke command value, compensating a generated error value and outputting it; a first microcomputer for outputting a switching control signal according to an output of the stroke calculating unit and the stroke voltage compensating unit; an electric circuit unit for applying a voltage to the linear compressing unit by ON/OFF controlling an input AC power voltage through a triac according to the switching control signal of the first microcomputer; and a noise removing unit for removing a noise contained in the switching control signal generated from the first microcomputer in occurrence of an instantaneous power failure.

To achieve the above objects, there is also provided an operation control method of a linear compressor including the steps of: judging whether a temperature inside the refrigerator is an upper limit temperature of a temperature set by a user, and applying a switching ON signal to supply power to a motor to drive the linear compressor if the temperature inside the refrigerator is an upper limit temperature of the temperature set by the user; and applying a switching OFF signal to cut off power supply to the motor if the temperature inside the refrigerator is not the upper limit temperature of the temperature set by the user.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
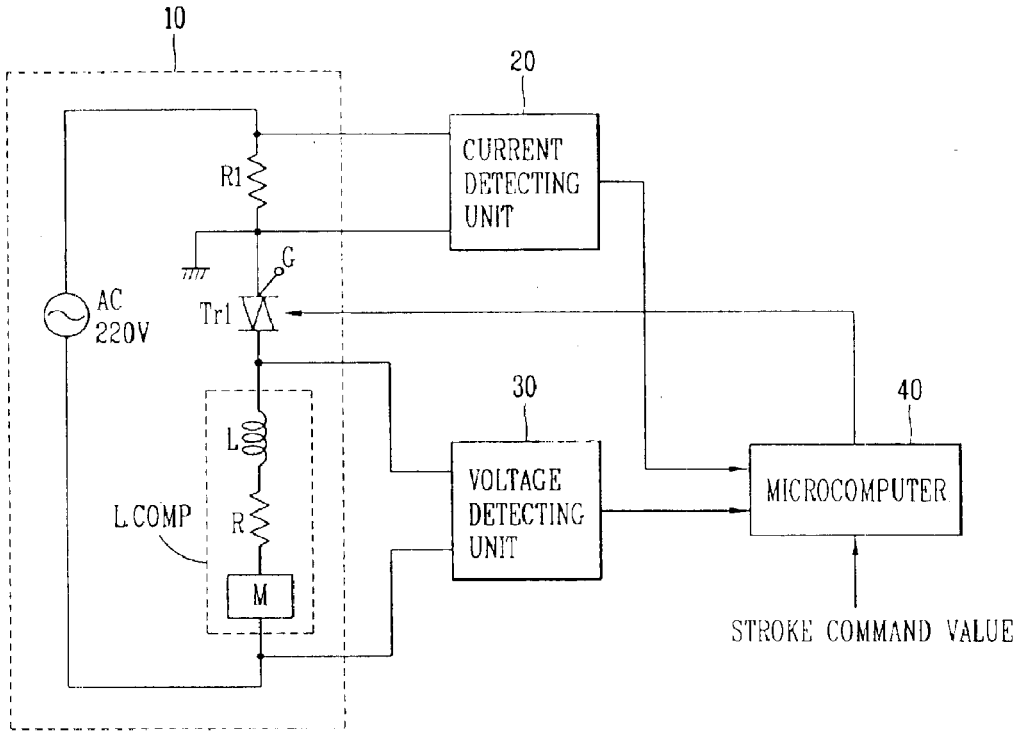
FIG. 1 BACKGROUND ART
FIG. 1 illustrates an operation control apparatus of a linear compressor in accordance with a conventional art.
Figure 2:
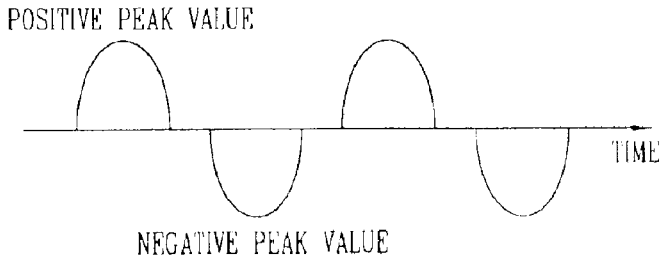
FIG. 2 BACKGROUND ART
FIG. 2 shows waveforms of a current applied to a linear compressing unit of FIG. 1.
Figure 3:
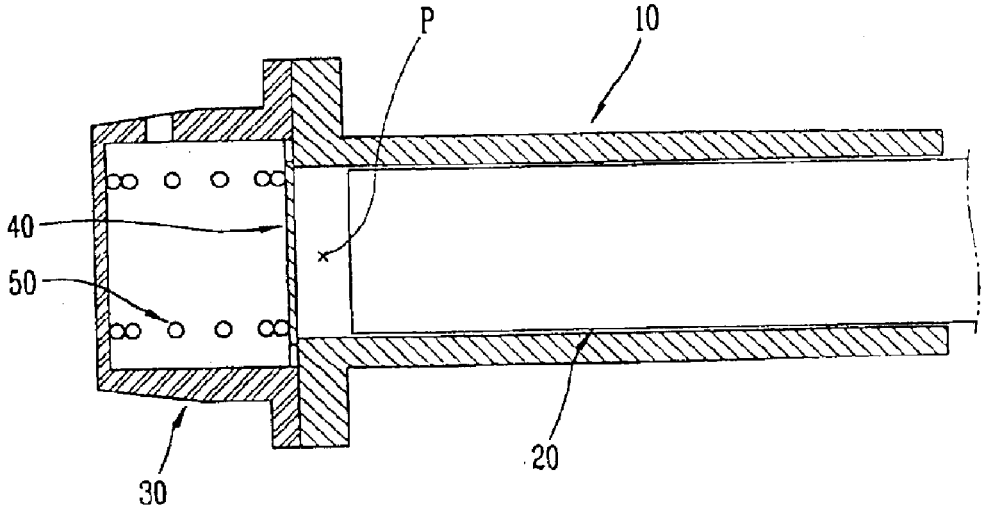
FIG. 3 BACKGROUND ART
FIG. 3 shows an example of an operating unit of a general linear compressor.
Figure 4:
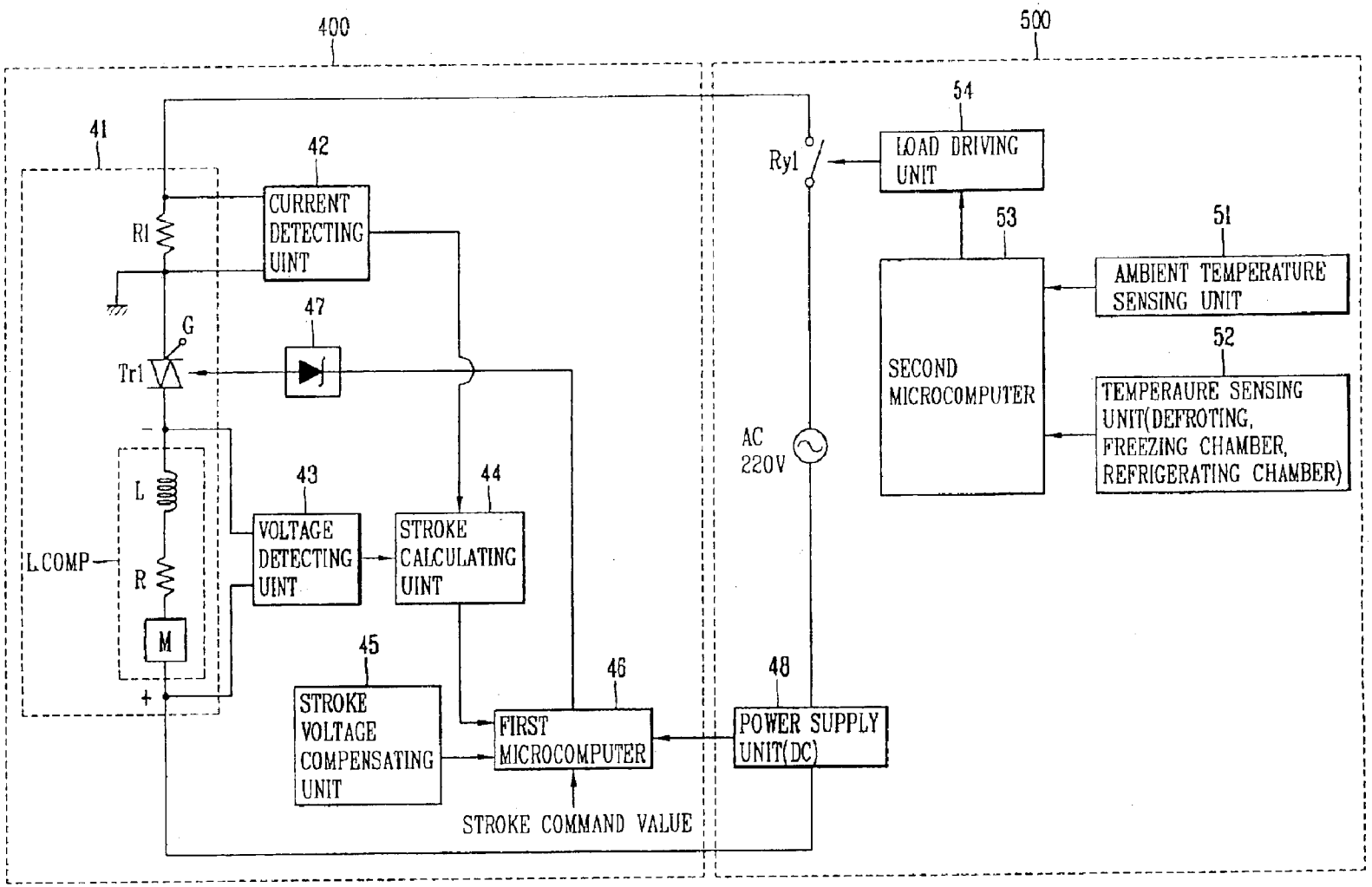
FIG. 4 shows the construction of one operation control apparatus of a linear compressor in accordance with the present invention.

FIG. 4 shows the construction of one operation control apparatus of a linear compressor in accordance with the present invention.

As shown, an operation control apparatus of a linear compressor in accordance with the present invention includes: a controller 400 of a linear compressor for controlling a cooling force by varying a stroke according to a vertical movement of a piston by an applied voltage; and a main controller 500 of a refrigerator for sensing an ambient temperature of a refrigerator and a temperature inside the refrigerator.

The main controller 500 of a refrigerator includes: an ambient temperatures sensing unit 51 for sensing an ambient temperature around the refrigerator; a second microcomputer 53 for outputting a control signal according to the temperature state of a temperature sensing unit 52 for sensing an inner temperature of the refrigerator; a load driving unit 54 for receiving an ON/OFF control signal for driving the linear compressor from the second microcomputer 53 and outputting a drive signal to the linear compressor; a relay (Ry1) switched by the driving signal and supplying an AC power to a motor (M) of the linear compressing unit (L.COMP); and a power supply unit 48 for converting the AC power to a DC power and supplying power to each unit of the linear compressor.

The controller 400 of the linear compressor includes: a current detecting unit 42 for detecting a current applied to the linear compressing unit (L.COMP) by increasing a stroke according to a voltage applied to the motor; a voltage detecting unit 43 for detecting a voltage generated at the linear compressing unit (L.COMP); a stroke calculating unit 44 for detecting a stroke at a certain time point according to the current and the voltage respectively detected by the current detecting unit 42 and the voltage detecting unit 43; a stroke voltage compensating unit 45 for comparing the detected stroke at a certain time point and a reference stroke command value, compensating a generated error value and outputting it; a first microcomputer 46 for outputting a switching control signal according to an output of the stroke calculating unit 44 and the output of the stroke voltage compensating unit 45; an electric circuit unit 41 for ON/OFF controlling an input AC power voltage through a triac (Tr1) according to the switching control signal of the first microcomputer 46 and applying a voltage to the linear compressing unit (L.COMP); and a noise removing unit 47 for removing a noise contained in the switching control signal generated from the first microcomputer 46 in occurrence of an instantaneous power failure.

Figure 5:
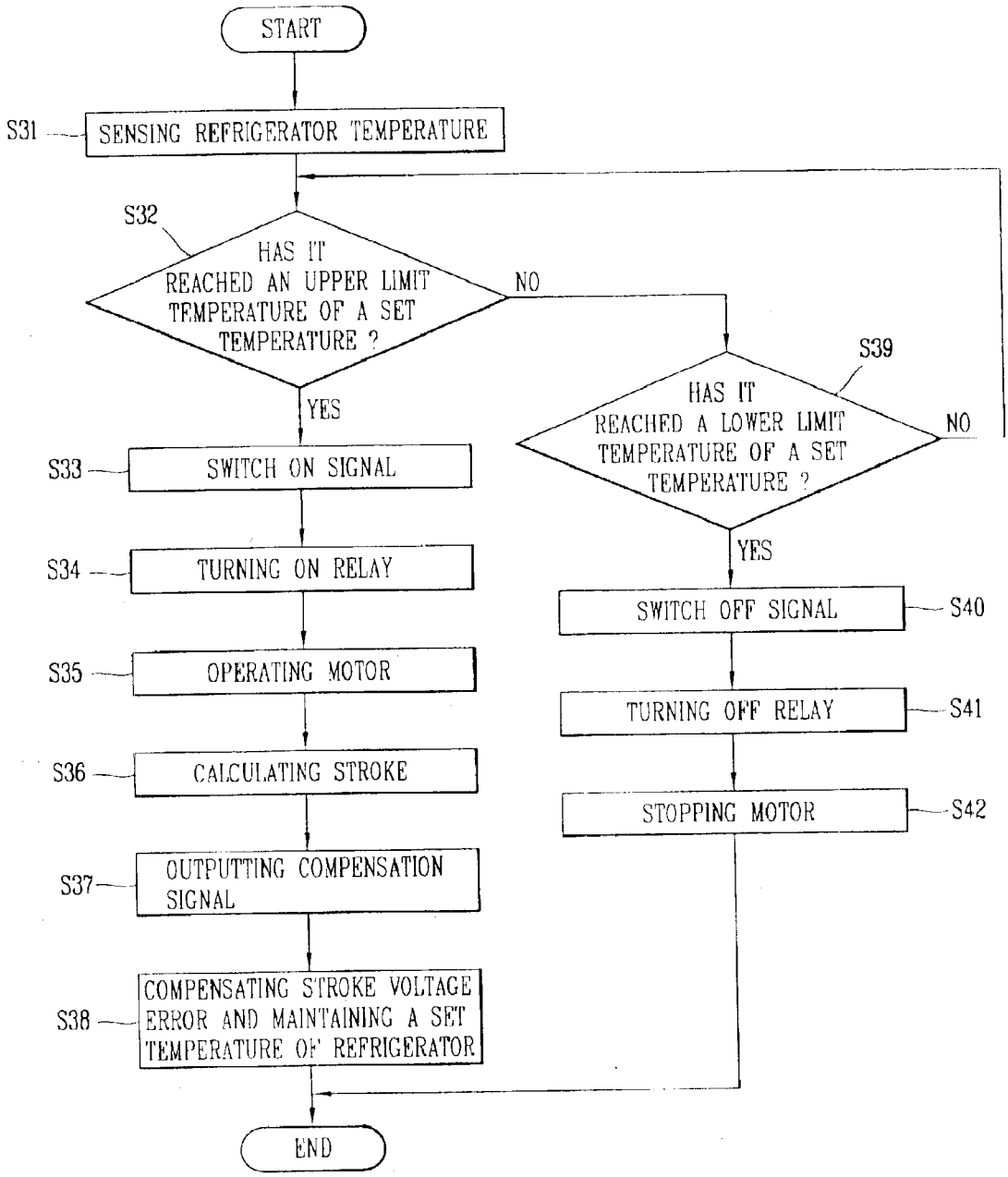
FIG. 5 is a flow chart of an operation control method of the linear compressor in accordance with the present invention.

FIG. 5 is a flow chart of an operation control method of the linear compressor in accordance with the present invention.

As shown, an operation control method of the linear compressor controlling a cooling force by varying a stroke includes: a step in which it is judged whether a temperature inside the refrigerator is an upper limit temperature of a temperature set by a user, and if the temperature inside the refrigerator is the upper limit temperature of a temperature set by the user, a switching ON signal is applied to supply power to the motor to drive the linear compressor; and a step in which if the temperature inside the refrigerator is not the upper limit temperature of a temperature set by the user, a switching OFF signal is applied to cut off power supply to the motor.

The operation principle and operation effect of the operation control apparatus of a linear compressor constructed as described above will now be explained with reference to FIG. 5.

In the refrigerator, a cooling force is adjusted by controlling a distance of a stroke to maintain a temperature set by the user.

First, in order to maintain a temperature inside the refrigerator at the temperature as set by the user and keep a food item fresh, the main controller 500 of the refrigerator receives a sensing result through the ambient temperature sensor unit 51 and the temperature sensing unit 52 and outputs a control signal to the load driving unit 54 (step S31).

At this time, it is judged whether the temperature inside the refrigerator has reached an upper limit temperature of a temperature set by the user. If the temperature inside the refrigerator has reached the upper limit temperature, the second microcomputer 53 of the main controller 500 outputs a switching ON signal for supplying an AC power to the controller 500 of the linear compressor, to the load driving unit 54 (steps S32 and S33).

Thereafter, according to the switching ON signal of the load driving unit 54, AC power is applied to each unit of the controller 400 of the linear compressor through the relay (Ry1), so that the motor (M) of the linear compressing unit (L.COMP) is driven (at this time, the triac (Tr1) is in an ON state).

Accordingly, the piston is vertically moved in the linear compressing unit (L.COMP) by the applied voltage according to the stroke command value set by the user, and thus, the stroke is varied to control the cooling force (steps S34 and S35).

In other words, as the turn-on period of the triac (Tr1) of the electric circuit unit 41 is lengthened by the switching control signal of the first microcomputer 46, the stroke increases, and then the motor of the linear compressing unit (L.COMP) is driven by the stroke.

At this time, the current detecting unit 42 detects the current applied to the linear compressing unit (L.COMP) and applies it to the stroke calculating unit 44, while the voltage detecting unit 43 detects the voltage applied to the linear compressing unit (L.COMP) and applies it to the stroke calculating unit 44.

The stroke calculating unit 44 receives the current value and the voltage value, calculates it and outputs a stroke voltage (step S36).

Thereafter, the stroke voltage compensating unit 45 compares the outputted stroke voltage and the reference stroke command value. If the stroke voltage is smaller than the reference stroke command value, the stroke voltage compensating unit 45 outputs a compensation signal corresponding to a stroke voltage compensated with more than a certain voltage to the first microcomputer 46 (step S37).

Upon receiving the compensation signal, the first microcomputer 46 compensates an error of the stroke voltage and outputs a switching control signal so that it can be a stroke voltage of a standard motor.

Accordingly, the first microcomputer 46 controls a turn-on time of the triac (Tr1) and drives the motor (M) of the linear compressing unit (L.COMP) in order to compensate the error of the stroke calculating unit 44, thereby maintaining the temperature inside the refrigerator at a set temperature (step S38).

At this time, in case that the DC power applied from the power supply unit 48 to the first microcomputer 46 is instantly turned on or off (power failure), the noise removing unit 47, the noise removing unit 47 prevents the phenomenon that the triac (Tr1) is instantaneously turned on so that the motor (M) of the linear compressor (L.COMP) is malfunctioned irrespective of a triac operation signal by the first microcomputer 46.

In other words, the Zener diode is connected in the opposite direction of a direction in which a gate terminal signal of the triac (Tr1) is inputted from the first microcomputer 46 in the opposite direction of a direction in which a gate terminal signal of the triac (Tr1) is inputted, so that the moment that the DC power is instantaneously turned on/off, the instantaneous switching signal is cut off by using the current flow characteristics when a voltage above a breakdown voltage is applied to the triac.

Therefore, the switching with a voltage above the breakdown voltage is inputted from the first microcomputer 46 to the gate terminal of the triac (Tr1) to turn it on, and the triac (Tr1) is prevented from being turned on in occurrence of instantaneous power failure, and thus, a malfunction of the motor (M) of the linear compressing unit (L.COMP) is prevented.

And then, the second microcomputer 53 judges that the temperature sensed by the ambient temperature sensor unit 51 and the temperature sensing unit 52 is a lower limit temperature of the temperature set by the user (step S39). Then, the load driving unit 54 receives a control signal for a switching OFF signal from the second microcomputer 53 and turns off the relay (Ry1) (steps S40 and S41).

Consequently, as the AC power supply is cut off, the motor (M) of the linear compressing unit (L.COMP) is stopped (step S42).

Thus, the temperature of the refrigerator is maintained at the set temperature by turning on/off the controller of the linear compressor according to the temperature sensed by the ambient temperature sensor unit 51 and the temperature sensing unit 52 of the main controller 500 of the refrigerator.

Figure 6:
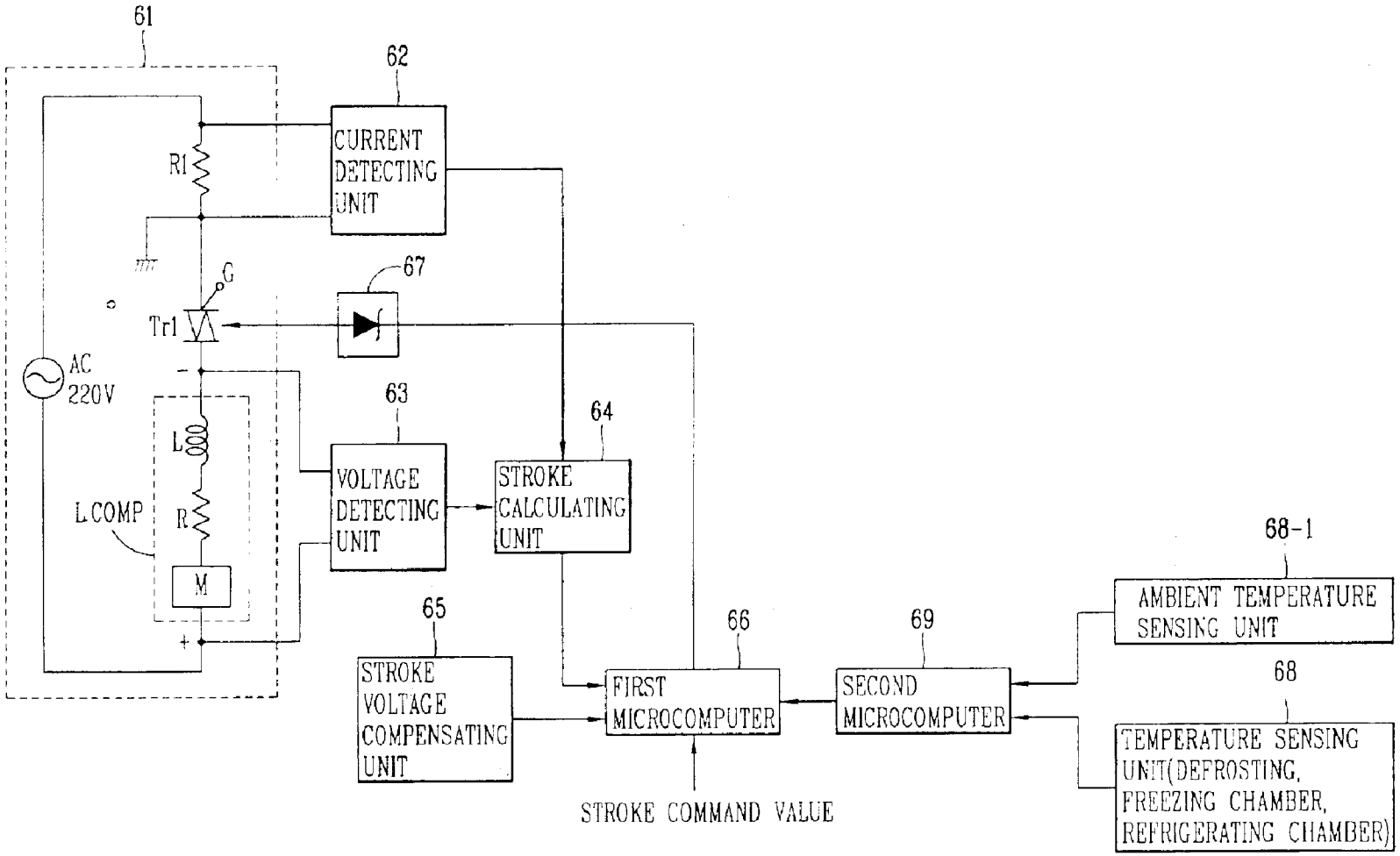
FIG. 6 shows the construction of another operation control apparatus of a linear compressor in accordance with the present invention.

FIG. 6 shows the construction of another operation control apparatus of a linear compressor in accordance with the present invention.

As shown, a linear compressor which controls a cooling force by varying a stroke with a vertical movement of the piston by a voltage applied to an internal motor (M0 according to a stroke command value, includes: a current detecting unit 62 for detecting a current applied to the linear compressing unit (R-COMP) by increasing a stroke by a voltage applied to the motor; a voltage detecting unit 63 for detecting a voltage generated at the linear compressing unit (L.COMP) as the stroke is increased by a voltage applied to the motor; a stroke calculating unit 64 for detecting a stroke at a certain time point according to the current and the voltage respectively detected by the current detecting unit 62 and the voltage detecting unit 63; a stroke voltage compensating unit 65 for comparing the detected stroke at a certain time point and a reference stroke command value, compensating a generated error value and outputting it; a first microcomputer 66 for outputting a switching control signal according to the output of the stroke calculating unit 64 and the output of the stroke voltage compensating unit 65; an electric circuit unit 61 for applying a voltage to the linear compressing unit (L.COMP) by ON/OFF controlling an AC power through a triac (Tr1) according to a switching control signal of the first microcomputer 66; a noise removing unit 67 for removing a noise contained in the switching control signal generated from the first microcomputer 66 in occurrence of an instantaneous power failure; and a second microcomputer 69 for sensing an ambient temperature around the temperature and a temperature inside the refrigerator by the ambient temperature sensing unit 68-1 and the temperature sensing unit 68 and outputting a data according to the temperature and a data according to the state of the linear compressor to the first microcomputer 66.

Figure 7:
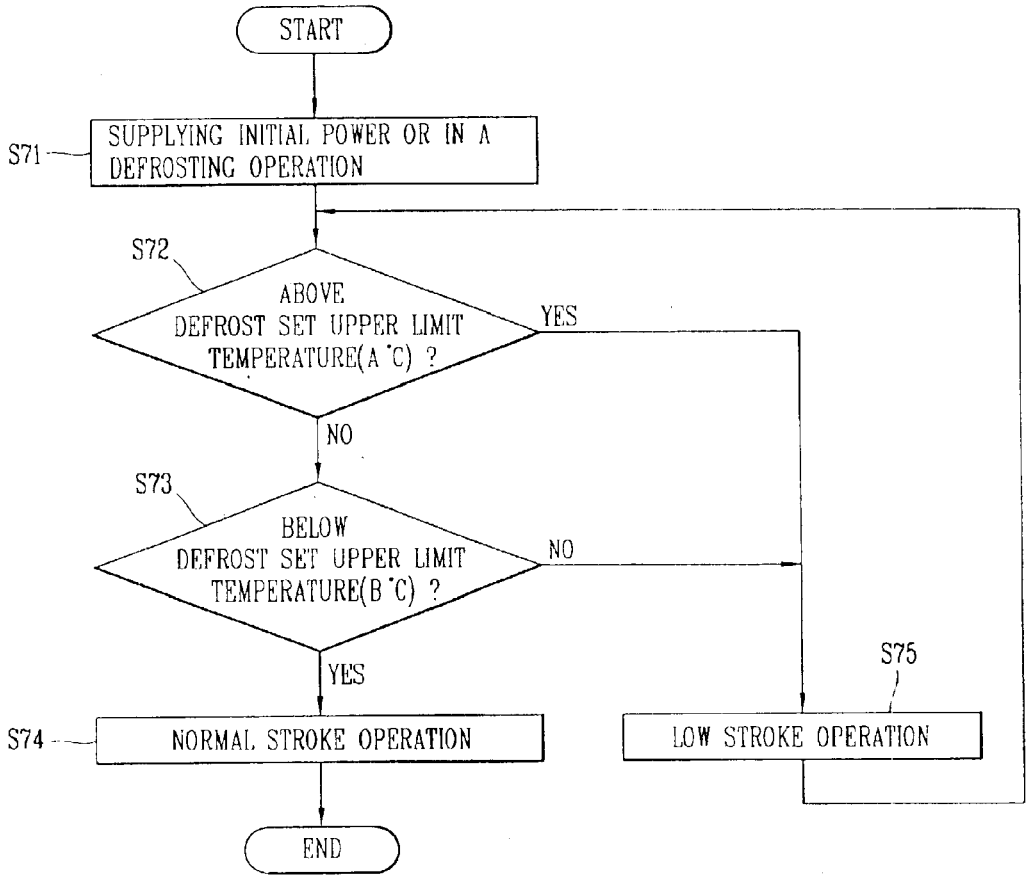
FIG. 7 is a flow chart of an operating method of the operation apparatus of the linear compressor of FIG. 6.

FIG. 7 is a flow chart of an operating method of the operation apparatus of the linear compressor of FIG. 6.

As shown, an operating method of the operation apparatus of the linear compressor in which a cooling force is controlled by varying a stroke by a vertical movement of a piston by virtue of an applied voltage according to a stroke command value, including: a step in which it is judged whether the temperature sensed by a defrosting sensor is above a defrost set upper limit temperature; a step in which it is judged whether the temperature sensed by the defrosting sensor is not above the frost set upper limit temperature but below a defrost set lower limit temperature, and if the temperature sensed by the defrosting sensor is below the defrost set lower limit temperature, the situation is sensed as being in a defrost mode or sensed as a case that an initial power has been supplied, so that a motor is controlled with a voltage of a normal stroke; and a step in which if the sensed temperature is above the defrost set upper limit temperature, the motor is controlled with a low stroke voltage as the situation is sensed as a post-defrosting mode or initial power input time.

The operation principle and an operation effect of another operation control apparatus of a linear compressor constructed as described above will now be explained with reference to FIG. 7.

The stroke calculating unit 64, the stroke voltage compensating unit 65, the noise removing unit 67 are operated in the same manner as those in the former operation control apparatus of a linear compressor of FIG. 4.

The second microcomputer 69 drives the motor (M) of the linear compressor by exchanging a data with the first microcomputer 66.

First, the second microcomputer 69 receives a temperature state from the temperature sensor unit 68-1 which senses an external temperature of the refrigerator and the temperature sensing unit 68 which senses temperatures of a freezing chamber and a refrigerating chamber of a refrigerator, displays the temperature state on a display window (not shown), and inputs the temperature inside the refrigerator and the state of the refrigerator to the first microcomputer 66 which controls the linear compressor.

Thereafter, the first microcomputer 66 controls the linear compressor, which will now be described in detail.

If defrost is formed on a evaporator as portion of moisture contained in a food item is circulated along with cooling air and frozen, the frost is sensed by the defrosting sensor attached on the evaporator and a defrosting heater is heated according to a defrosting operation and removed Subsequently, the operation of the defrosting heater is stopped, and the second microcomputer 69 writes a data corresponding to the temperature state of the interior of the refrigerator. Then, the first microcomputer 66 controls operation of the motor (M) of the linear compressing unit (L.COMP) with a normal stroke voltage or a low stroke voltage.

The above process ensures a reliability in case the refrigerator is overloaded after an initial power is supplied or the refrigerator is in a defrosting operation mode.

The process that after the initial power is supplied or after a defrosting operation is performed, the first microcomputer 50 receives the data corresponding to the inputted temperature state from the second microcomputer and performs the stroke operation controlling according to a defrost set temperature will now be described.

First, after an initial power is supplied or when the refrigerator is in a defrosting operation mode, the first microcomputer 66 judges whether a data corresponding to a temperature inputted from the second microcomputer is above a defrost set upper limit temperature (A° C.) (steps S71 and S72). If the data is not higher than the defrost set upper limit temperature (A° C.), the first microcomputer 66 judges whether the data is below a defrost set lower limit temperature (B° C.) (step S73).

If the data is below the defrost set lower limit temperature (B° C.), the first microcomputer 66 controls a stroke distance of the piston with a normal stroke voltage, thereby controlling a cooling force inside the refrigerator (step S74).

If, however, the data is above the defrost set upper limit temperature (A° C.), the second microcomputer 69 outputs a data regarding the defrost set upper limit temperature (A° C.) to the first microcomputer 66.

Then, the first microcomputer 66 controls so that a period of the gate signal of the triac Tr1 is controlled with a low stroke voltage in order for the motor to escape stably from the overload state while increasing the stroke distance gradually, thereby driving the motor (M) of the linear compressing unit (L.COMP).

As so far described, the operation control apparatus and method of a linear compressor of the present invention have the following advantages.

That is, first, in order to prevent an instantaneous signal output of the gate of the triac regardless of an operation signal of the motor, the Zener diode is connected in a reverse direction of the direction in which the gate signal is supplied to the triac. Thus, thanks to the characteristics of the Zener diode that a reverse current is disregarded until it reaches a breakdown voltage, a switching control signal possibly supplied from the microcomputer to the triac in occurrence of an instantaneous power failure can be cut off and thus a malfunction of the linear compressor can be prevented.

In addition, the temperature inside the refrigerator is sensed by using the defrosting sensor. Thus, when an initial power input is sensed, the stroke voltage of the linear compressor is controlled to be lower than in a general operation control state, and if a temperature sensed by the defrosting sensor is below a defrost set temperature, the stroke voltage is gradually increased to perform the linear compressor with a normal stroke voltage, thereby controlling the temperature inside the refrigerator suitably.

Moreover, the discharge valve is not damaged since the piston does not collide with the discharge valve, and a reliability of the linear compressor is obtained in case of an overload.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An operation control apparatus of a linear compressor, comprising:

an ambient temperature sensor unit for sensing an outer ambient temperature of a refrigerator;

a temperature sensing unit for sensing a temperature inside a refrigerator;

a microcomputer for outputting a control signal according to a temperature state of the ambient temperature sensor unit and the temperature sensing unit;

a load driving unit for receiving an ON/OFF control signal for driving a linear compressor from the microcomputer and outputting a drive signal to the linear compressor;

a relay switched by the driving signal and supplying an AC power to a motor of the linear compressor;

a power supply unit for converting the AC power into a DC power and supplying power to each unit inside the linear compressor;

a current detecting unit for detecting a current applied to the linear compressor by increasing a stroke by a voltage applied to a motor;

a voltage detecting unit for detecting a voltage generated at the linear compressor;

a stroke calculating unit for detecting a stroke at a certain time point according to the current and the voltage, respectively, detected by the current detecting unit and the voltage detecting unit;

a stroke voltage compensating unit for comparing the detected stroke at the certain time point and a reference stroke command value, compensating a generated error value, and outputting it;

a second microcomputer for outputting a switching control signal according to an output of the stroke calculating unit and the stroke voltage compensating unit;

an electric circuit unit for applying a voltage to the linear compressing unit by ON/OFF controlling an input AC power voltage through a triac according to the switching control signal of the second microcomputer; and a noise removing unit for removing a noise contained in the switching control signal generated from the second microcomputer in occurrence of an instantaneous power failure.

2. The apparatus of claim 1, wherein when an input switch signal above a certain breakdown voltage is generated, the noise removing unit allows a current to flow to the triac, whereas when an input switch signal below a certain breakdown voltage is generated, the noise removing unit cuts off a current flowing to the triac.

3. The apparatus of claim 1, wherein the noise removing unit is a Zener diode.

4. The apparatus of claim 1, wherein the noise removing unit is a Zener diode.

5. An operation control apparatus of a linear compressor, comprising:

a current detecting unit for detecting a current applied to a linear compressor by increasing a stroke by a voltage applied to a motor;

a voltage detecting unit for detecting a voltage generated at the linear compressing unit;

a stroke calculating unit for detecting a stroke at a certain time point according to the current and the voltage, respectively, detected by the current detecting unit and the voltage detecting unit;

a stroke voltage compensating unit for comparing the detected stroke at the certain time point and a reference stroke command value, compensating a generated error value, and outputting it;

a microcomputer for outputting a switching control signal according to an output of the stroke calculating unit and the stroke voltage compensating unit; and an electric circuit unit for applying a voltage to the linear compressor by ON/OFF controlling an input AC power voltage through a triac according to the switching control signal of the microcomputer.

6. The apparatus of claim 5, further comprising:

a noise removing unit for removing a noise contained in the switching control signal generated from the microcomputer in occurrence of an instantaneous power failure.

7. The apparatus of claim 6, wherein when an input switch signal above a certain breakdown voltage is generated, the noise removing unit allows a current to flow to the triac, whereas when an input switch signal below a certain breakdown voltage is generated, the noise removing unit cuts off a current flowing to the triac.

8. The apparatus of claim 6, wherein the noise removing unit is a Zener diode.

9. An operation control apparatus of a linear compressor, comprising:

a current detecting unit for detecting a current applied to the linear compressor by increasing a stroke by a voltage applied to a motor;

a voltage detecting unit for detecting a voltage generated at the linear compressor;

a microcomputer for detecting a stroke at a certain time point according to the current and the voltage, respectively, detected by the current detecting unit and the voltage detecting unit, comparing the detected stroke at the certain time point and a reference stroke command value, and outputting a switching control signal according to the comparison value;

an electric circuit unit for applying a voltage to the linear compressor by ON/OFF controlling an input AC power voltage through a triac according to the switching control signal of the microcomputer; and a noise removing unit for removing a noise contained in the switching control signal generated from the microcomputer in occurrence of an instantaneous power failure.

10. The apparatus of claim 9, wherein when an input switch signal above a certain breakdown voltage is generated, the noise removing unit allows a current to flow to the triac, whereas when an input switch signal below a certain breakdown voltage is generated, the noise removing unit cuts off a current flowing to the triac.

11. The apparatus of claim 9, wherein the noise removing unit is a Zener diode.

12. A main controller of a refrigerator, comprising:

an ambient temperature sensor unit for sensing an outer ambient temperature of a refrigerator;

a temperature sensing unit for sensing a temperature inside a refrigerator;

a microcomputer for outputting a control signal according to a temperature state of the ambient temperature sensor unit and the temperature sensing unit;

a load driving unit for receiving an ON/OFF control signal for driving a linear compressor from the microcomputer and outputting a drive signal to the linear compressor;

a relay switched by the driving signal and supplying an AC power to a motor of the linear compressor; and a power supply unit for converting the AC power into a DC power and supplying power to each unit inside the linear compressor.

13. A controller of a linear compressor, comprising:

a current detecting unit for detecting a current applied to the linear compressor by increasing a stroke by a voltage applied to a motor;

a voltage detecting unit for detecting a voltage generated at the linear compressor;

a stroke calculating unit for detecting a stroke at a certain time point according to the current and the voltage, respectively, detected by the current detecting unit and the voltage detecting unit;

a stroke voltage compensating unit for comparing the detected stroke at the certain time point and a reference stroke command value, compensating a generated error value, and outputting it;

a microcomputer for outputting a switching control signal according to an output of the stroke calculating unit and the stroke voltage compensating unit;

an electric circuit unit for applying a voltage to the linear compressor by ON/OFF controlling an input AC power voltage through a triac according to the switching control signal of the microcomputer; and a noise removing unit for removing a noise contained in the switching control signal generated from the microcomputer in occurrence of an instantaneous power failure.

14. The controller of claim 13, wherein when an input switch signal above a certain breakdown voltage is generated, the noise removing unit allows a current to flow to the triac, whereas when an input switch signal below a certain breakdown voltage is generated, the noise removing unit cuts off a current flowing to the triac.

15. An operation control apparatus in which a cooling force is controlled by varying a stroke by a vertical movement of a piston by virtue of a voltage applied to an internal motor according to a stroke command value, comprising:

a current detecting unit for detecting a current applied to the linear compressor by increasing a stroke by a voltage applied to a motor;

a voltage detecting unit for detecting a voltage generated at the linear compressor by increasing a stroke by a voltage applied to the motor;

a stroke calculating unit for detecting a stroke at a certain time point according to the current and the voltage, respectively, detected by the current detecting unit and the voltage detecting unit;

a stroke voltage compensating unit for comparing the detected stroke at the certain time point and a reference stroke command value, compensating a generated error value, and outputting it;

a first microcomputer for outputting a switching control signal according to an output of the stroke calculating unit and the stroke voltage compensating unit;

an electric circuit unit for applying a voltage to the linear compressor by ON/OFF controlling an AC power through a triac according to the switching control signal of the first microcomputer;

a noise removing unit for removing a noise contained in the switching control signal generated from the first microcomputer in occurrence of an instantaneous power failure; and a second microcomputer for outputting a data according to an ambient temperature outside and a temperature inside a refrigeration which are respectively sensed by an ambient temperature sensing unit and a temperature sensing unit, to the first microcomputer.

16. The apparatus of claim 15, wherein when an input switch signal above a certain breakdown voltage is generated, the noise removing unit allows a current to flow to the triac, whereas when an input switch signal below a certain breakdown voltage is generated, the noise removing unit cuts off a current flowing to the triac.

17. The apparatus of claim 15, wherein the noise removing unit is a Zener diode.

18. An operation control method of a linear compressor in which a cooling force is controlled by varying a stroke by a vertical movement of a piston by virtue of an applied voltage according to a stroke command value, comprising;

judging whether a temperature sensed by a defrosting sensor is above a defrost set upper limit temperature;

judging whether the temperature sensed by the defrosting sensor is not above the defrost set upper limit temperature but below a defrost set lower limit temperature, and if the temperature sensed by the defrosting sensor is below the defrost set lower limit temperature, controlling a motor with a voltage of a normal stroke; and if the sensed temperature is above the defrost set upper limit temperature, sensing that the system is in a defrost mode or in a case that an initial power has been supplied, controlling the motor of the linear compressor with a low stroke voltage.

19. An operation control method of a linear compressor, comprising:

outputting an ON/OFF control signal according to an outer ambient temperature of a refrigerator and a temperature inside the refrigerator;

outputting a drive signal to a linear compressor upon receiving the ON/OFF control signal;

supplying an AC power to a motor of the linear compressor according to the drive signal; and converting the AC power to a DC power and supplying the DC power to each unit of the linear compressor.

20. An operation control method of a linear compressor, comprising:

detecting a current applied to the linear compressor by increasing a stroke by virtue of a voltage applied to a motor;

detecting a voltage generated at the linear compressor;

detecting a stroke at a certain time point according to the detected current and voltage;

comparing the detected stroke at a certain time point and a reference stroke command value, compensating a generated error value, and outputting it;

outputting a switching control signal according to the compensated stroke value; and applying a voltage to the linear compressor by ON/OFF controlling an input AC power voltage through a triac according to the switching control signal.

21. The method of claim 20, further comprising:

removing a noise contained in the switching control signal in occurrence of an instantaneous power failure.

* * * * *